United States Patent [19]

Leslie et al.

[11] 4,145,963

[45] Mar. 27, 1979

[54] JAM-CLEARING AND TORQUE SENSING TRACTION WHEEL ASSEMBLY AND STRAP FEED STOPPING MECHANISM

[75] Inventors: John H. Leslie, Winnetka; George A. Crosby, Long Grove, both of Ill.

[73] Assignee: Signode Corporation, Glenview, Ill.

[21] Appl. No.: 840,146

[22] Filed: Oct. 11, 1977

Related U.S. Application Data

[63] Continuation-in-part of Ser. No. 738,702, Nov. 3, 1976, abandoned.

[51] Int. Cl.[2] ..... B65B 13/04

[52] U.S. Cl. ..... 100/4; 100/26; 226/25; 226/37; 226/188

[58] Field of Search ..... 100/4, 26; 64/28 R, 64/29, 30 R; 226/188, 25, 37

[56] References Cited

U.S. PATENT DOCUMENTS

| | | | |
|---|---|---|---|
| 3,086,451 | 4/1963 | Van DerWal | 100/26 |
| 3,146,695 | 9/1964 | Van DeBilt | 100/4 |
| 3,269,300 | 8/1966 | Billett | 100/4 X |
| 3,589,275 | 6/1971 | Van DeBilt | 100/26 X |
| 3,644,701 | 2/1972 | Kobayashi | 226/25 X |

*Primary Examiner*—Billy J. Wilhite
*Attorney, Agent, or Firm*—Dressler, Goldsmith, Clement, Gordon & Shore, Ltd.

[57] ABSTRACT

A combination jam-clearing and torque sensing traction wheel assembly and strap feed stopping mechanism is disclosed for use in a strapping machine which feeds strap in a chute about an article to form a loop and subsequently tensions the loop tightly about the article. The strap is fed into the chute by a rotating traction wheel which is driven through a torque sensing assembly comprising a driven plate, a spring-biased driver plate, and drive motor. Feeding of the strap is intermittently stopped and started as the driver plate is forced out of engagement with the driven plate when the torque increases beyond a predetermined amount in response to increased strap feed resistance resulting from an obstruction in the chute. In one embodiment, the strap feed stopping mechanism includes a permanent strap end abutment member located just past the strap overlap region in the strapping machine. When the strap free end hits the abutment member, the driver plate is forced out of engagement with the driven plate and feeding of the strap is terminated. In another embodiment, the strap feed stopping mechanism includes a ratchet wheel and a pawl actuated by a sensor in the strap chute and which is responsive to the strap free end location in the chute when a loop is being formed. Tripping of the sensor by the strap free end actuates a mechanism to move a pawl into engagement with the ratchet wheel to prevent further strap feed rotation of the traction wheel secured thereto. Additionally, the restraint against the traction wheel rotation causes the driver plate to disengage from the traction wheel.

21 Claims, 12 Drawing Figures

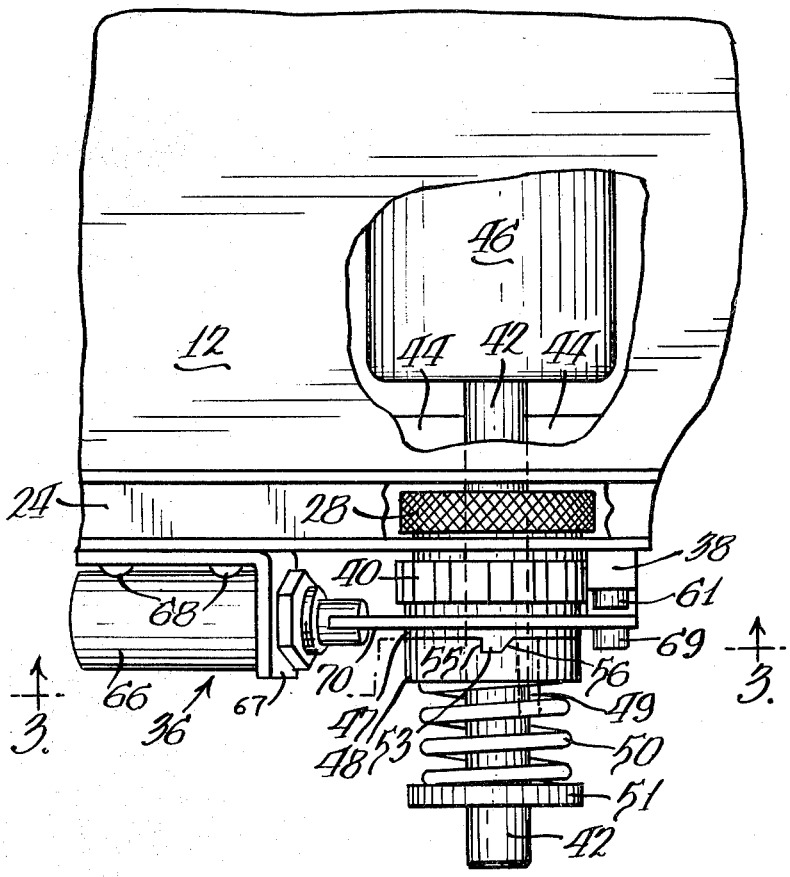
Fig. 2.
Fig. 4.
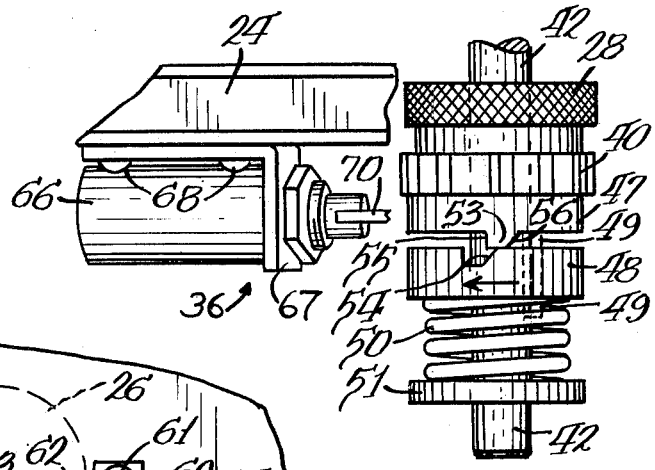
Fig. 3.
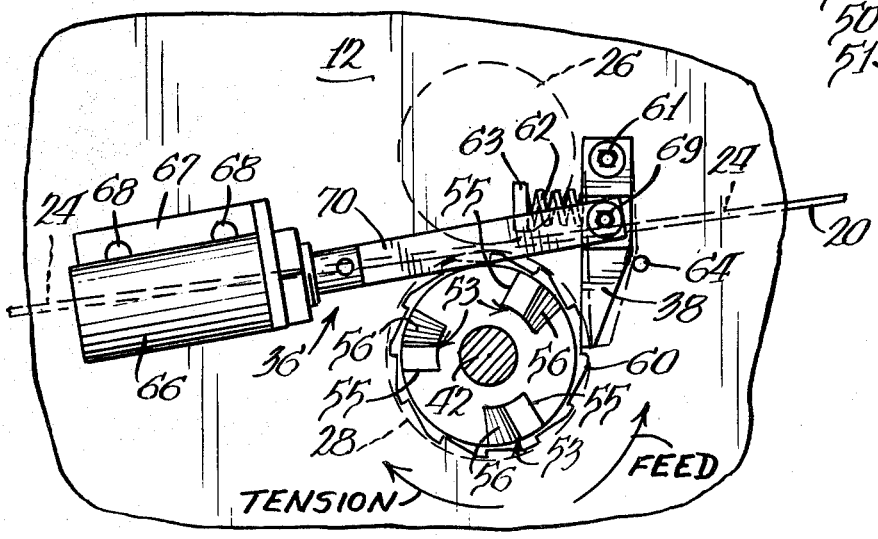

JAM-CLEARING AND TORQUE SENSING TRACTION WHEEL ASSEMBLY AND STRAP FEED STOPPING MECHANISM

CROSS-REFERENCE TO RELATED APPLICATION

This application is a Continuation-In-Part of our application Ser. No. 738,702 filed Nov. 3, 1976 now abandoned.

BACKGROUND OF THE INVENTION

In the recent past, Signode Corporation, the assignee of the entire interest of the present application, has developed several machines for feeding strap in a chute to form a loop around an article to be strapped and for tensioning the loop tight about an article. Typically, these machines also apply a seal to the tensioned loop and sever the tensioned and sealed loop from the standing, or trailing, length of strap. Typical of such machines is the one disclosed and claimed in the U.S. Pat. to G. A. Crosby et al., No. 2,915,003.

STRAP CHUTE OBSTRUCTION PROBLEMS

Some strapping machines, such as the machine disclosed in the Crosby et al. patent, U.S. Pat. No. 2,915,003, are susceptible to strap jamming as the strap is fed in the strap chute and encounters extraneous obstructions that may have lodged in the chute. With machines currently in use, the strap continues to be fed when such an obstruction is encountered. This causes the strap to buckle away from, and out of engagement with, the strap track in the chute.

Some machines control the strap feeding in the chute by a cycle timer system and some machines just feed a predetermined length of strap. With either type of machine, the strap will continue to be fed, even though an obstruction is encountered, until the cycle is terminated. Obviously, in such a situation, the strap may buckle out of the chute and not form into a loop. Hence, the subsequent tensioning, sealing and severing actions of the machine, which are automatically initiated, would not produce a tightened loop about the package.

Other types of strapping machines terminate the strap feed by sensing the location of the strap free end after the loop has been formed. If an obstruction is encountered by the strap in the strap chute of such a machine, the strap may buckle out of the chute and will not form a loop. The strap will continue to be fed by the machine until terminated by an overall shut-off cycle timing system or other means.

It is desirable that a method and apparatus be developed which (1) will allow the feeding of a strap into the chute and (2) will, when an obstruction is encountered by the strap free end, automatically terminate the feeding of the strap. It would also be desirable to provide a means whereby the strap feeding, after being terminated when the strap free end hits an obstruction, can be automatically continued in an attempt to clear the obstruction. In fact, it would be desirable to provide a mechanism whereby the feeding of the strap can be readily started and stopped to produce a "fluttering" effect of the strap free end. This would tend to cause the strap free end to pass by an obstruction in the chute or knock such an obstruction from the chute.

STRAP FEED TERMINATION PROBLEMS

In strapping machines in use today, a means is provided to terminate the strap feeding process once a complete loop has been formed with the strap and after a small portion of the strap free end has overlapped a portion of the loop. A number of methods are currently employed to terminate the strap feeding process and have already been briefly described above. The use of these methods has certain drawbacks which will be discussed here.

In one method, a predetermined length of strap is fed by accurately controlling the feeding cycle of the machine. This involves accurately indexing the strap feed, or traction, wheel a certain number of rotations. Such a method requires complicated and expensive motors and control systems. Further, a strap cannot be fed very rapidly with such a system.

A second method requires feeding of the strap at a constant feed rate for a predetermined length of time. Such a method involves a timer control circuit and is inherently less reliable than the other methods that directly control the length of strap that is fed.

Another method for terminating the strap feeding process upon formation of the loop is to provide a motor cut-off limit switch actuated by a sensing lever in the strap chute, the lever being impinged by the strap free end after formation of a complete loop. Machines that employ a strap feed termination system with a limit switch and sensing lever typically have the lever located "ahead" of the strap sealing unit. Such machines rely upon motor momentum to feed the strap free end beyond the sensing lever and adjacent the sealer unit where the strap free end hits an abutment and stops completely. However, the impingement of the strap free end against the abutment tends to cause the strap to buckle in the chute. To accommodate this buckling, a "drop-out gate" is employed. The drop-out gate is an integral part of the strap chute which is hinged on one end and is spring biased on the other end into alignment with the strap chute track. When the strap free end impinges upon the terminal abutment beyond the sealing unit and begins to buckle, the strap pushes the drop-out gate away from the strap track. Any strap portion that would tend to form a buckling "hump" in the strap chute is accommodated in the open drop-out gate. This prevents any buckling from occurring within the chute strap track. Typical of such drop-out gate devices is the device disclosed in U.S. Pat. No. 2,915,003 to Crosby et al.

It has been found that the drop-out gate has a number of disadvantages. First of all, it is difficult to place the drop-out gate on a small chute where it will not interfere with the actual operation of the machine or placement of the package to be strapped. In addition, the drop-out gate requires a more complicated strap chute and therefore makes a strapping machine more expensive. It has also been found that the drop-out gate bias spring is quite sensitive and must be carefully adjusted. Too much biasing force results in the strap buckling elsewhere in the chute and too little biasing force results in premature opening of the drop-out gate.

It would be desirable to provide a strapping machine wherein the drop-out gate can be eliminated and wherein rotation of the strap feed wheel is immediately terminated when the strap loop has been formed. This would prevent motor momentum from continuing to feed the strap and causing buckling. In addition, the precise amount of overlap in the loop could be regulated accurately if the rotation of the traction wheel were immediately terminated when the predetermined amount of desired overlap was achieved. Further, it would be desirable to also disengage the motor drive from the traction wheel when the loop has been formed. This would permit the motor to continue running at speed and be available for the subsequent machine operations.

SUMMARY OF THE INVENTION

The apparatus of the present invention utilizes a unique system for terminating the strap feeding process upon formation of a loop in the strap chute or upon the strap free end encountering an obstruction in the strap chute.

The novel torque sensing assembly, which stops strap feeding when a chute obstruction is encountered, will first be described. A means is provided to disengage the motor from the traction wheel when an obstruction is encountered by the strap free end as it is guided around the strap chute during the feeding process. The traction wheel is mounted on a drive shaft which is in turn driven by a motor. The traction wheel is mounted so that it may rotate relative to the shaft. A driven member or wheel is secured to the traction wheel for rotating with it relative to the shaft. The driven wheel has a protrusion presenting a first shoulder surface parallel to the axis of rotation of the shaft and a second shoulder surface at an angle with respect to the axis of rotation of the shaft. Adjacent the driven wheel is a driver plate which is mounted on the shaft for sliding therealong and which is keyed thereto against relative rotation. The driver plate has a recessed wall structure or channel for engaging the protrusion on the driven wheel member in mating relationship with the first and second shoulder surfaces. The driver plate is urged along the shaft into engagement with the driven wheel by a helical spring disposed about the shaft. One end of the spring is restrained on the shaft and the other end of the spring abuts the driver plate and urges it from a position disengaged with the driven wheel to a position in engagement with the driven wheel.

Since the driver plate is keyed to the shaft, the driver plate rotates with the shaft at all times when the drive motor is operating to rotate the shaft. The helical spring biases the driver plate against the driven wheel whereby the driven wheel can be rotated in either direction. In one direction of shaft rotation, the strap is fed, and in the other direction the strap is tensioned.

The first shoulder surface of the driven wheel engages a portion of the recessed wall structure of the driver plate so that the driver plate can rotate the driven wheel and traction wheel in a direction to tension the strap. When the shaft is rotated in the other direction—the direction tending to rotate the traction wheel to feed the strap—the second, or slanting, shoulder surface of the driven wheel is engaged by a portion of the recessed wall structure. But for the bias spring, the slanted surface of the driven wheel shoulder would cause the recessed wall of the driver plate to slide along the slanted shoulder surface and out of engagement with the surface. However, the helical spring urges the driver plate against the driven wheel and maintains the driving relationship therebetween. The biasing force of the helical spring is overcome only when a certain amount of torque is reached. At that point, the driver plate becomes disengaged from the driven wheel.

Normally, when the strap is fed into the strap chute, the strap encounters very little resistance in the strap track. Consequently, the traction wheel requires relatively very little torque to feed the strap. However, should the strap free end encounter an obstruction in the strap chute, the resistance to the forward feeding strap movement is transmitted through the traction wheel to the driven wheel. Additional torque is then required to move the strap forward. With the helical spring set to exert a predetermined force, the driver plate can be forced outwardly, by the slanted surface of the driven wheel shoulder, against the spring and will eventually be forced completely out of engagement with the driven wheel. Thus, when an obstruction is encountered, the driver plate disengages from the driven wheel and the feeding of the strap is terminated. However, the shaft is still being rotated by the motor so that as the driver plate rotates, the recessed wall structure in the plate is likewise rotated to again engage a protrusion. This allows the motor to drive the traction wheel to feed the strap forward again. If the obstruction is still present, the increased resistance is still transmitted to the traction wheel and driven wheel, thereby causing the driver plate to again become disengaged. This process is repeated as long as the obstruction is present. The rapid, intermittent starting and stopping of the strap feed process causes the strap free end to vibrate or "flutter" in the strap chute. This fluttering effect is valuable in causing the strap free end to overcome or pass by an obstruction in the chute. The fluttering may tend to dislodge the obstruction or may tend to cause the strap to pass under, around, or through the obstruction and thereby permit the strap to complete the loop.

The mechanism for terminating the strap feed upon formation of the loop will now be described. The strap is fed, by a traction wheel, into a strap chute wherein it is guided to form a loop about an article placed therein. When the strap free end has been guided within the strap chute to form a complete loop, it impinges upon a sensing lever at the appropriate location in the strap chute. In one embodiment, the lever is connected to a limit switch in a control circuit for actuating an electric solenoid to move a pawl into engagement with a ratchet wheel secured to the traction wheel. In a modification of this, the lever is directly connected to the pawl by an appropriate mechanical linkage. In either case, this action stops the rotation of the traction wheel in the strap feed direction.

In the preferred embodiment, the motor drive is disengaged from the traction wheel when the complete loop has been formed and when the traction wheel has been stopped from rotating by the pawl and ratchet wheel mechanism previously described. Specifically, when the loop has been formed and the limit switch has been actuated to engage the pawl to stop the ratchet rotation, the ratchet wheel causes the driving wheel to disengage in the same manner as it would disengage under an increased torque resistance resulting from an obstruction in the strap chute. Consequently, when the strap loop has been formed, the motor is immediately disengaged from the traction wheel to thereby prevent the motor from being "locked" with the stopped traction wheel. The motor can thus be kept running and could, through appropriate controls and transmissions, be then immediately drivably engaged with the same traction wheel, or with a different traction wheel, to rotate the traction wheel in the opposite, loop tensioning direction or could be drivably engaged to operate another machine function.

In another embodiment of the present invention, a strap feed stopping mechanism is employed which incorporates a strap end abutment member just beyond the joint forming area. When the strap free end is fed completely around the chute to form a loop, the strap free end impinges against the strap end abutment member and, as in the case of an obstruction in the strap chute, causes the driver plate of the torque sensing clutch to become disengaged, thereby terminating the strap feeding. Suitable controls may be used to stop the motor if desired. With strap having an appropriate section modulus and with suitable strap feeding speeds and strap loop sizes, the use of such permanent strap abutment member eliminates the need for the more complicated pawl and ratchet wheel mechanism as well as eliminates the need for a drop-out gate assembly.

Numerous other advantages and features of the present invention will become readily apparent from the following detailed description of the invention and of embodiments thereof, from the claims and from the accompanying drawings in which each and every detail shown is fully and completely disclosed as a part of this specification.

BRIEF DESCRIPTION OF THE DRAWINGS

In the accompanying drawings forming part of the specification, and in which like numerals are employed to designate like parts throughout the same.

FIG. 2 is an enlarged, partial, fragmentary top view taken generally along the plane 2—2 of FIG. 1 to show the actual details of the apparatus;

FIG. 3 is a partial, side view taken along the plane 3—3 of FIG. 2;

FIG. 4 is a partial, fragmentary top view similar to FIG. 2;

DESCRIPTION OF THE PREFERRED EMBODIMENT

Figure 1:
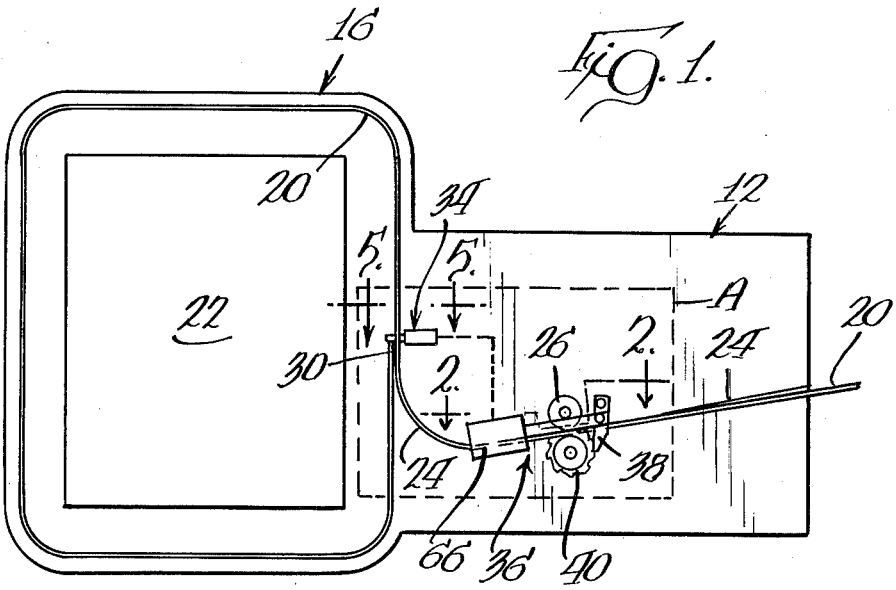
FIG. 1 is a side view of a strapping machine showing the apparatus of the present invention represented in a simplified diagrammatic manner.

While this invention is susceptible of embodiment in many different forms, there are shown in the drawings and will herein be described in detail preferred embodiments of the invention. It should be understood, however, that the present disclosure is to be considered as an exemplification of the principles of the invention and is not intended to limit the invention to the embodiments illustrated.

For ease of description, the apparatus of this invention will be described in normal operating position, and terms such as upper, lower, horizontal, etc., will be used with reference to this normal operating position. It will be understood, however, that apparatus of this invention may be manufactured, stored, transported and sold in orientation other than the normal operating position described.

The apparatus of this invention has certain conventional drive mechanisms and control mechanisms which, though not fully illustrated or described, will be apparent to those having skill in the art and an understanding of the necessary functions of such drive mechanisms causing proper operation of the apparatus in the manner as will be explained.

A typical power strapping machine is illustrated diagrammatically in FIG. 1 where the main controls, drive motors, transmissions, gripping, sealing, and severing mechanisms are located in housing 12. A chute 16 is located adjacent the front of the housing 12 and receives strap 20 which is fed on the inner periphery of the chute 16 around a package or article 22 which is disposed within the chute and maintained therein by appropriate support members (not shown). Typical of such machines are those disclosed and claimed in the following U.S. patents:

Crosby et al. U.S. Pat. No. 2,915,003
Crosby et al. U.S. Pat. No. 3,023,693
H. T. Martin U.S. Pat. No. 3,088,397

The combination strap feed stop mechanism and jam-clearing and torque sensing traction wheel assembly of the present invention is diagrammatically illustrated in dashed box A in FIG. 1. A conventional strap guide 24 is located in housing 12 and receives strap 20 from a conventional strap supply reel (not shown). The strap 20 runs through guide 24 in the housing and into chute 16.

The strap is fed (and subsequently tensioned) through housing 12 by a conventional traction wheel drive. The traction wheel drive typically consists of upper idler wheel 26 and a lower traction wheel 28 (not visible in FIG. 1, but illustrated in FIG. 2). The idler wheel 26 is typically biased against traction wheel 28 so that the strap 20 is gripped therebetween by the peripheral surfaces of the two wheels. The strap 20 is fed through strap guide 24 from right to left, as viewed in FIG. 1, and counterclockwise about chute 16 to form a loop with the strap free end 30 overlapping a portion of the loop inside the chute 16. After the loop has been formed, feeding of the strap 20 is terminated and the strap free end 30 is gripped or restrained from movement (by mechanisms not shown). The strap 20 is then drawn by the traction wheel drive in the direction to tension and tighten the loop about the article 22. When the loop has been drawn tight about the article 22, the overlapping portions of the strap are secured together by appropriate means, such as by friction fusion, application of an independent seal, or by formation of an interlocking slit type joint. Mechanisms for performing these operations, as well as the mechanism for severing the loop from the trailing portion of strap 20 are all typically located within housing 12 and are not individually illustrated in FIG. 1.

JAM-CLEARING AND TORQUE SENSING TRACTION WHEEL ASSEMBLY

In some types of strapping machines it would be desirable to provide a simple mechanism for rapidly starting and stopping the traction wheel rotation during the feeding of a strap in a chute when an obstruction or area of excessive friction is encountered. Termination of the traction wheel rotation will initially prevent the strap from buckling when it hits the obstruction. Subsequent rotation of the traction wheel will tend to move the strap forward again into the obstruction, which may now be dislodged. If the obstruction is not dislodged, the feeding process would again be terminated and then subsequently restarted. If this procedure is carried out rapidly enough, the end of the strap would "flutter" and may then possibly pass under, around, or through the obstruction or area of excessive friction and then complete the path in the chute to form the loop.

A novel jam-clearing and torque sensing traction wheel assembly for achieving the above described objective is illustrated in FIGS. 2, 3 and 4. The assembly can also be combined in a novel manner with the strap feed stop mechanism (to be fully described hereinafter in a separate section). The unique combination provides an apparatus which not only incorporates the novel jam-clearing feature but also immediately terminates the rotation of the traction wheel upon formation of the strap loop and simultaneously disengages the drive motor from the stopped traction wheel while the motor is rotating.

To aid in understanding the details of the jam-clearing and torque sensing traction wheel assembly and its combination with the strap feed stop mechanism, a simple overall operational description will first be presented.

As is diagrammatically illustrated in FIG. 1, a sensor means 34 is provided to sense the location of the strap free end 30 in the chute 16 when the strap loop has been formed. The rotation of the traction wheel 28 is terminated by a latch means responsive to the sensor means 34. The latch means comprises an actuator means 36 and pawl 38 arranged to engage a ratchet wheel 40 which is secured to the traction wheel 28.

A novel arrangement of the traction wheel 28 and ratchet wheel 40 is illustrated in detail in FIG. 2. A shaft 42 is journaled in the frame bearing 44 and is driven by a motor 46. Traction wheel 28 is mounted on shaft 42 for rotation relative thereto. Traction wheel 28 is located on the shaft 42 in alignment with, and below, strap guide 24. In the preferred embodiment, ratchet wheel 40 is an integral extension of traction wheel 28 and, as such, rotates with the traction wheel 28 relative to shaft 42.

The ratchet wheel 40, as well as the associated sensor means 34, actuator 36 and pawl 38, which comprise the strap feed stop mechanism, are not necessary for proper functioning of the jam-clearing feature associated with the torque sensing traction wheel assembly. To that extent, the components which comprise the strap feed stop mechanism may be initially ignored in FIGS. 2 through 4. After the jam-clearing feature has been separately and fully described, a description will be presented covering strap feed stop mechanism in detail, as well as the novel combination of, and interrelationship between, the strap feed stop mechanism and jam-clearing and torque sensing traction wheel assembly.

As illustrated in FIGS. 2 and 4, a torque sensing clutch means is provided to disengage the drive motor 46 from the traction wheel 28. To this end, a driven means or plate 47 is provided as an integral extension of the traction wheel 28. In the embodiment illustrated in FIGS. 2 through 4, the traction wheel 28 has a large extension piece which is formed into an integral driven plate 47 and ratchet wheel 40. The driven plate 47 therefore can rotate with the traction wheel 28 and ratchet wheel 40 relative to the shaft 42.

A driver means or driver plate 48 is mounted for sliding along shaft 42 but is keyed to the shaft 42 by spline 49 against relative rotation. The driver plate 48 is urged between a driving position in contact with the driven plate 47, as illustrated in FIG. 2, and a disengaged position spaced away from the driven plate 47, as illustrated in FIG. 4, by a bias means or bias spring 50. The bias spring 50 is a helical type spring disposed about shaft 42 and restrained thereto on one end by flange 51 which projects from shaft 42. The other end of bias spring 50 is compressively engaged against the driver plate 48. The bias spring 50 thus rotates with shaft 42 and the driver plate 48.

The driven plate 47 and the driver plate 48 are adapted to be drivably engaged by protrusions 53 which project from the face of driven plate 47 and mating recesses 54 formed in the face of driver plate 48. The driven plate 47 has three such protrusions 53 circumferentially spaced 120° apart and the driver plate 48 has three mating recesses 54. Each protrusion 53 has a first shoulder surface 55 parallel to the axis of rotation of the shaft 42 and a second shoulder surface 56 at an angle to the axis of rotation of the shaft 42. Each recess 54 in the driver plate 48 is channel-shaped, the interior surface of which conforms to the surfaces of the protrusions 53.

The driver plate 48 can drive the driven plate 47 and traction wheel 28 counterclockwise, as viewed in FIG. 3, to feed the strap. In FIG. 4, the driver plate 48 is shown disengaged from the driven plate 47. As shaft 42 is rotated in the direction of the arrow, the disengaged driver plate 48 is also rotated in the direction of the arrow owing to its splined engagement on the shaft. After the shaft has rotated 120°, the recesses 54 again become aligned with the protrusions 53 on the driven plate 47. At that point, the driver plate 48 is urged by bias spring 50 along shaft 42 towards driven plate 47 and into engagement therewith as shown in FIG. 2. In the engaged position, with the shaft 42 rotating in the direction of the arrow, the strap can be fed by the traction wheel 28 (from right to left in FIG. 2) to form a loop in the chute. The torque from the motor 46 is transmitted through the shaft 42 and into the driver plate 48 through spline 49. The slanted wall of each recess 54 engages the second shoulder, or slanted, surface 56 of each mating protrusion 53. The torque of the motor is thus transmitted through the mating slanted surfaces when the strap is being fed.

If an obstruction is encountered in the strap chute by the strap free end as it is fed around the chute, the additional resistance caused by the obstruction is transmitted along the strap to the traction wheel 28 and to the driven plate 47. To overcome the additional resistance, the driver plate 48 must be rotated with more torque by motor drive 46. By appropriate choice of the spring constant for bias spring 50, the force that the bias spring 50 exerts upon driver plate 48 can be established so that the driver plate 48 disengages in response to the increased torque required to rotate the driven plate 47 when an obstruction is encountered in the chute. In such a situation, the slanted surfaces of the recesses 54 slide along the slanted second shoulder surfaces 56, compressing bias spring 50 to disengage the driver plate 48 from the driven plate 47 (whereby the driver plate 48 and driven plate 47 assume the orientation as illustrated in FIG. 4).

When the driver plate 48 disengages from the driven plate 47 as described above upon an obstruction being encountered by the leading end of the strap in the strap chute, the shaft 42 is still being rotated by the motor. Thus, the driver plate 48 continues to rotate and the recesses 54 in the driver plate 48 are rotated back into engagement with the protrusions 53. This allows the motor to drive the traction wheel 28 to feed the strap forward again. If the obstruction is still present, the increasing resistance is still transmitted to the traction wheel 28 and the driven plate 47, thereby causing the drive plate 48 to again become disengaged. This process is repeated as long as the obstruction is present. The rapid, intermittent starting and stopping of the strap feed process causes the strap free end to vibrate or "flutter" in the strap chute. This fluttering effect is valuable in causing the strap free end to overcome or pass by an obstruction in the chute. The fluttering may tend to dislodge the obstruction or may tend to cause the strap to pass under, around, or through the obstruction and thereby permit the strap to complete the loop.

The torque sensing clutch means also accommodates the rotation of the shaft 42 in a direction necessary to tension and tighten the strap about the article. When the shaft is rotated clockwise (as viewed in FIG. 3) with the driven plate 47 and driver plate 48 engaged, the traction wheel 28 draws the strap 20 from left to right (as viewed in FIG. 2) to tension the strap and tighten the loop about the package. In this mode, the first shoulder surfaces 55 of the protrusions 53 are engaged by the recesses 54.

The jam-clearing and torque sensing traction wheel assembly can also be used in conjunction with the strap feed stop mechanism to terminate the strap feed process after the loop has been formed and to disengage the drive motor from the traction wheel while the drive motor is allowed to continue running. This feature will be described in the following section on the strap feed stop mechanism.

STRAP FEED STOP MECHANISM

As was noted in the "Summary of the Invention" above, the apparatus of the present invention provides a novel and unique way of terminating the feeding of the strap upon formation of the strap loop about an article. Two embodiments of a subassembly or mechanism for terminating the feeding of a strap upon formation of the strap loop about an article will next be described. The first embodiment includes a positive latching device and the second embodiment includes a strap end abutment means which, in combination with the torque sensing clutch, eliminates the need for a positive latching device.

FIRST EMBODIMENT: POSITIVE LATCH

It was briefly stated in the preceding section that the preferred embodiment of the strap feed stop mechanism, diagrammatically illustrated in FIG. 1, comprises a sensor means 34, actuator 36, pawl 38, and ratchet wheel 40. The novel arrangement of the traction wheel 28 and ratchet wheel 40 is illustrated in detail in FIG. 2 and was previously described in detail in the preceding section. The rotation of the traction wheel 28 is terminated by a latch means responsive to the sensor means 34. The latch means comprises the actuator means 36 and pawl 38 and is best illustrated in FIG. 3. The ratchet wheel has teeth 60 which can be engaged by pawl 38. Pawl 38 is pivotally mounted to a portion of housing 12 by bolt, or pin, 61. In a preferred embodiment, spring 62 is disposed in commpression on one end to pawl 38 and on the other end to support 63 for biasing the pawl 38 away from ratchet wheel 40 against stop pin 64 (as illustrated by the dashed lines in FIG. 3) to disengage teeth 60 and allow rotation of ratchet wheel 40 in the counterclockwise direction.

An electric solenoid actuator 66 is secured to a portion of housing 12 by bracket 67 with bolts 68 and is pivotally connected to pawl 38 with pin or bolt 69 on the end of arm 70. When the electric solenoid is de-energized, the arm 70 and pawl 38 assume the location shown by dashed lines in FIG. 3. In the energized mode, the electric solenoid 66 retracts arm 70 to the left (as viewed in FIG. 3) to rotate pawl 38 about pivot bolt 61 until pawl 38 engages teeth 60. By design, the spring 62 is chosen so that its spring force is less than the "pulling" force exerted by the energized electric solenoid 66 upon pawl 38 so that the spring can be overcome to allow pawl 38 to engage teeth 60.

Note that even when the solenoid 66 is energized, the ratchet wheel 40 can still be rotated in the clockwise direction. When rotating in the clockwise direction, the ratchet wheel teeth 60 overcome the energized holding force of the solenoid 66 and push the pawl 38 outwardly from the ratchet wheel 40 as they rotate past the pawl.

The electric solenoid 66 is de-energized during the strap feeding process to maintain pawl 38 out of engagement with the ratchet wheel 40. To terminate the feeding process, the power circuit of electric solenoid 66 is closed thereby energizing the solenoid to engage the pawl 38 with the ratchet wheel 40. Closure of the power circuit is effected in response to the sensor means 34 when the strap loop has been formed in the chute 16 as will hereinafter be described.

Figure 5:
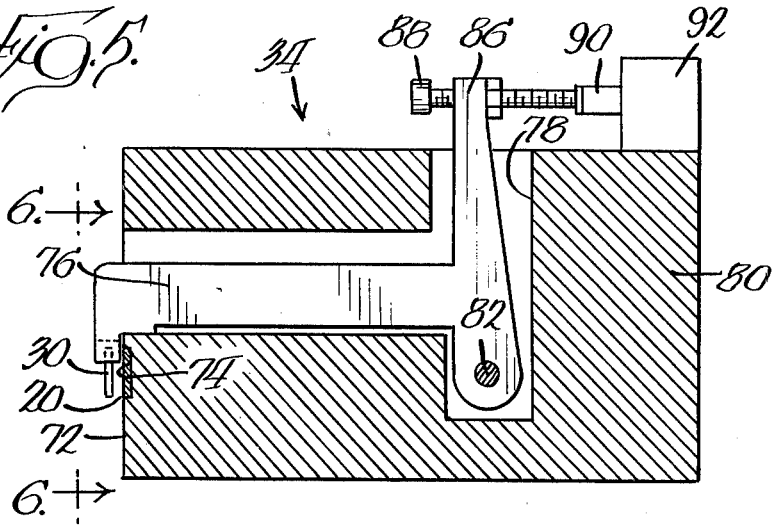
FIG. 5 is an enlarged, partial sectional view taken generally along the plane 5—5 of FIG. 1 to show the details of the apparatus of the present invention.
Figure 6:
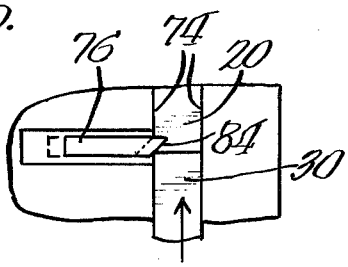
FIG. 6 is a partial front view taken generally along the plane 6—6 of FIG. 5.

The sensor means 34 is best illustrated in FIGS. 5 and 6. The front face 72 of housing 12 is aligned with the inner surface of chute 16 providing a continuous track for the strap 20. A strap channel 74 is provided in face 72 to receive strap 20 which forms a loop inside the strap chute 16. The strap free end 30 is fed around the strap chute 16 to overlap a portion of the strap loop at the front face 72. A sensing lever 76 is mounted in a T-shaped cavity 78 in support block 80. Lever 76 pivots in cavity 78 about pin 82. As illustrated in FIG. 6, lever 76 has an angled impingement face 84 which projects slightly in front of the strap channel 74 and in the path of the strap free end 30. The vertical placement of lever 76 is chosen to provide the desired amount of overlap of the strap loop by the strap free end 30. When the strap 20 has been fed into the chute 16 to form a loop so that the strap free end 30 has overlapped the loop by the desired amount, the strap free end 30 impinges upon the impingement face 84 of lever 76 and causes lever 76 to pivot about pin 82. The impingement face 84 is thus forced out of the path of the strap free end 30 to the position indicated by the dashed lines in FIG. 6.

Lever 76 has an arm 86 on which is mounted an adjustment screw 88. Screw 88 is set to contact a conventional spring-biased lever arm 90 of a limit switch 92. When the strap free end 30 causes lever 76 to rotate about pin 82, screw 88 is forced against lever arm 90 to close or open, as the case may be, the electrical contacts in limit switch 92. The combination of the lever 76 and switch 92 thus comprise a sensor means for sensing the strap free end 30 when the loop has been formed in the chute.

Through appropriate electrical control and power circuits, electrical solenoid 66 is maintained in the de-energized mode when the strap is being fed to form a loop and before the lever 76 is pivoted by the strap free end 30. When the lever 76 is tripped by the strap free end 30 upon formation of the loop, the electric solenoid 66 is energized against the action of spring 62 to pull pawl 38 into engagement with ratchet wheel 40 to immediately lock the traction wheel 28 against further rotation, thus stopping the strap feeding process.

Figure 7:
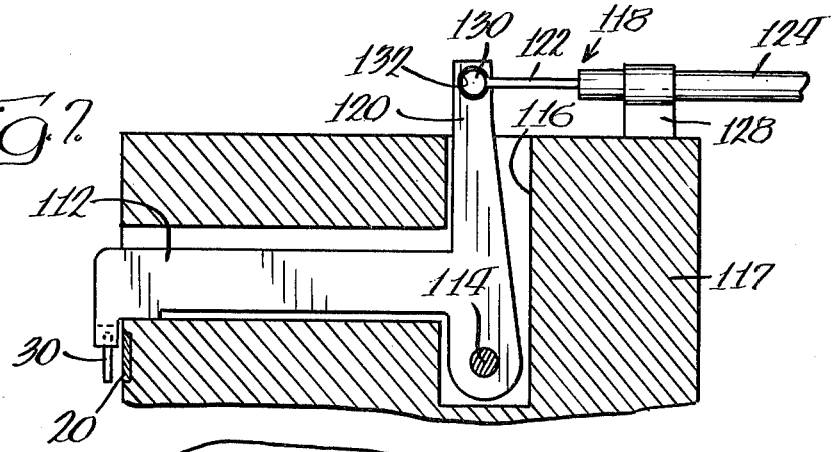
FIG. 7 is a partial sectional view similar to FIG. 5, but showing a modification of the apparatus of the present invention.
Figure 8:
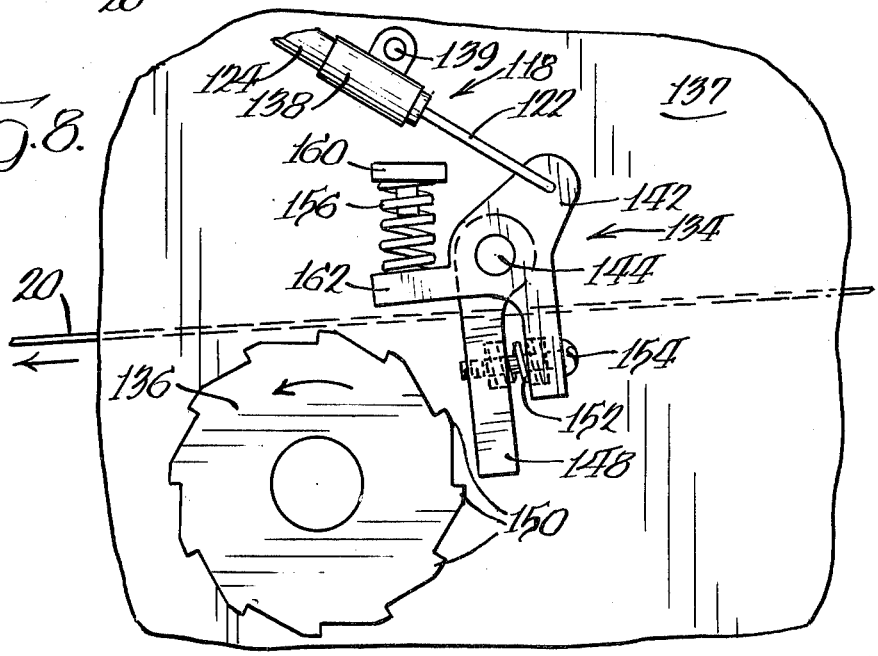
FIG. 8 is a sectional view similar to FIG. 3, but showing a modification of the apparatus of the present invention in a disengaged mode.
Figure 9:
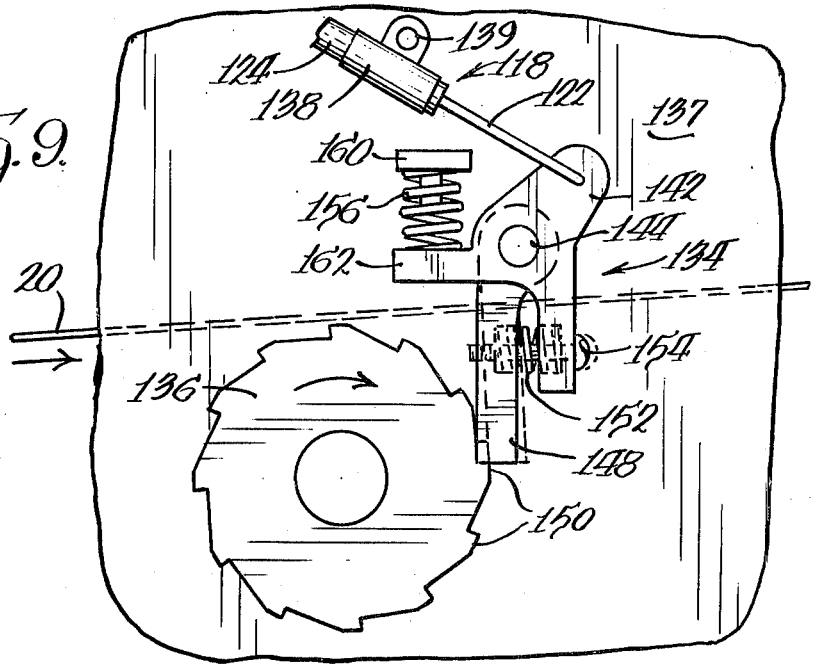
FIG. 9 is a view similar to FIG. 8 showing the modified apparatus of the present invention in an engaged mode.

A modification of the positive latching device of the present invention is illustrated in FIGS. 7 through 9. In this modification, a latch means for engaging the ratchet wheel is provided which does not require the use of an electric solenoid actuator. As illustrated in FIG. 7, a sensor means or sensing lever 112 is provided which is similar to the sensing lever 76 of the embodiment of FIG. 5 previously described.

The sensing lever 112 is pivotally mounted about pin 114 in a T-shaped channel 116 in support block 117. A flexible cable assembly 118 is mounted adjacent a projecting arm 120 of the sensing lever 112. The cable assembly 118 comprises a cable 122 contained in an outer shroud 124. The cable 122 is loosely disposed within the shroud 124 for sliding therein. Shroud 124 is secured near one end to the sensing lever 112 on block 117 by bracket 128. The very end of cable 122 is secured in a cylindrical plug 130 which is disposed within a cylindrical journal 132 on lever arm 120. When the strap loop has been formed within the chute 16, the strap free end 30 impinges upon the end of the sensing lever 112 and causes the sensing lever to rotate, or pivot, about pin 114 thereby pushing cable 122 along inside the shroud 124.

As illustrated in FIGS. 8 and 9, a pawl assembly 134 and ratchet wheel 136 are provided adjacent the housing 137 of the strapping machine. The other end of cable assembly 118 is connected to pawl assembly 134 for engagement with a ratchet wheel 136 (FIG. 8). As illustrated in FIG. 8, one end of the shroud 124 of cable assembly 118 is secured by a bracket 138 with screw or bolt 139 to a portion of the housing 137. The cable 122 is secured to an upper pawl member 142 which is pivotally mounted aobut pin 144 projecting from a portion of the housing 137. Also pivotally mounted about the pin 144 is the lower pawl member 148 which is adapted to engage teeth 150 of the ratchet wheel 136 as in the manner illustrated in FIG. 9. A pawl bias spring 152 is disposed in compressive engagement between the upper pawl member 142 and the lower pawl member 148 and urges the lower pawl member 148 toward the ratchet wheel 136. However, a limiting screw 154 is located on the longitudinal axis of the pawl bias spring 152 and is secured on one end, by threaded engagement, to lower pawl member 148. The other, or head end, of the limiting screw 154 passes freely through an aperture in the upper pawl member 142 and is not threaded thereto. The head of the limiting screw 154, when in contact with the upper pawl member 142, prevents the pawl bias spring 152 from urging the lower pawl member 148 away from the upper pawl member 142 beyond the length of the screw.

A sensing lever return spring 156 is compressively engaged between a spring support 160 secured to a portion of the housing 137 and a shoulder 162 on the upper pawl member 142. The sensing lever return spring 156 thus continuously biases the upper pawl member 142 to pivot about pin 144 in a counterclockwise direction as viewed in FIG. 8. This, of course, causes cable 122 to slide through shroud 124 to maintain the sensing lever 112 in the position shown in FIG. 7 wherein it projects into the path of the strap free end 30.

By appropriate choice of the sensing lever return spring 156, the entire pawl assembly 134 can be maintained in the position illustrated in FIG. 8. In this position, the lower pawl member 148 is disengaged from the ratchet wheel 136 and the cable 122 is pushed by the upper pawl member 142 to pivot the sensing lever 112 in the counterclockwise direction about pin 114 so that the lever projects into the path of the strap free end 30. Further, the spring force of the sensing lever return spring 156 is chosen so that the spring will be overcome by the impingement of the strap free end 30 against the sensing lever 112. That is, the lever 112, when hit by the strap free end 30, pushes the cable 122 in the direction to cause the upper pawl member 142 to compress spring 156 and force the lower pawl member 148 into engagement with the ratchet wheel 136. When the ratchet wheel 136 is so engaged, the rotation of the ratchet wheel is terminated. The ratchet wheel 136 is an integral extension of the traction wheel (not shown in FIG. 8 but identical to the configuration of the traction wheel 28 and ratchet wheel 40 illustrated in FIG. 2). Thus, the traction wheel rotation is terminated when the rotation of the ratchet wheel 136 is terminated to thereby stop the strap feeding process.

As illustrated in FIG. 9, the ratchet wheel 136 can be also rotated in the direction to tension the strap loop and draw it tight about the package. In that case, the lower pawl member 148 is forced outwardly from the ratchet wheel 136 by the teeth 150 as the ratchet wheel rotates in the clockwise direction (as viewed in FIG. 9). The lower pawl member 148 is then forced toward the upper pawl member 142, compressing pawl bias spring 152 in the process. Since the limiting screw 154 is threadingly engaged on one end with the lower pawl member 148 but is freely disposed on the other end within the upper pawl member 142, the head of the screw is moved outwardly away from its bearing engagement with the upper pawl member 142 to assume the position shown by dashed lines in FIG. 9.

In FIGS. 8 and 9, the sensing lever return spring 156 is shown compressively engaged with the shoulder 162 of the upper pawl member 142. Though not illustrated in FIG. 7, the sensing lever return spring could alternately be located adjacent the sensing lever 112 and secured thereto to directly urge the sensing lever to project into the path of the strap free end 30.

It is seen that the novel strap feed stop mechanism of the present invention immediately terminates rotation of the strap feed traction wheel upon formation of a strap loop with the desired amount of free end overlap. Note that in the illustrated embodiments, since the traction wheel is mounted for rotation relative to the shaft, the drive motor and shaft can continue to rotate even though the traction wheel is restrained from rotating. The use of this novel mechanism in a strapping machine wherein the rotation of the traction wheel is instantly terminated while the drive motor is free to continue rotating prevents undesirable strap overfeed owing to the drive motor momentum that exists after the power to the motor has been switched off.

The unique strap feed stop mechanism of the present invention can also be combined in a novel manner with a jam-clearing and torque sensing traction wheel assembly as will now be described.

Upon formation of a strap loop, the strap sensing lever and limit switch illustrated in FIG. 5 will be tripped by the strap free end 30 to actuate the latch means (e.g., electric solenoid and pawl) as heretofore described. When this occurs, the ratchet wheel rotation is terminated immediately, thereby stopping the traction wheel feeding process. The restraint of the ratchet wheel against further rotation in the strap feed direction presents an "infinite" resistance to the driver plate 48. Thus, the driver plate 48 disengages from the driven plate 47 in the same manner as was heretofore described with respect to the disengagement resulting from increased strap feed resistance caused by an obstruction in the chute. This, of course, permits the drive shaft 42 to continue rotating and thus avoids locking the motor drive 46 to the stopped ratchet wheel 40. Consequently, the drive motor 46 can continue turning at speed to furnish power to other mechanisms (not shown), if required. For example, if the strap were to be tensioned to tighten the loop by a second traction wheel (not shown) driven by the same drive motor 46 through an appropriate clutch and transmission mechanism (not shown), the tensioning process could then begin immediately wherein the second traction wheel would be driven by the still rotating motor drive 46. This would have the advantage of decreasing wear on the drive motor since the motor would not have to be stopped from rotating in the feeding direction and restarted to rotate in the opposite, tensioning direction. This would also decrease the total amount of time required to feed the strap and tension the loop since the drive motor would not have to be brought up to speed from a stopped condition at the start of the tensioning process.

SECOND EMBODIMENT: STRAP END ABUTMENT

When the strap free end hits an obstruction in the strap chute, the jam-clearing and torque sensing traction wheel assembly effects a novel and useful "flutter" response in the strap free end. This was previously described in the earlier section entitled "Jam-clearing and Torque Sensing Traction Wheel Assembly." It was explained that if a region of high friction or an obstruction is encountered in the strap chute by the strap free end as it is fed around the chute, the additional resistance caused by the obstruction is transmitted along the strap to the traction wheel 28 and to the driven plate 47 (FIGS. 2 and 4). The driver plate 48 disengages from the driven plate 47 in response to the increased torque required to rotate the driven plate 47 when the obstruction is encountered in the chute. The feeding process is thus terminated, at least for an instant. Since the drive motor 46 is continuing to rotate, the driver plate 48 continues to rotate until the recess 54 of the driver plate 48 re-engages the shoulder protrusions 53 in the driven plate 47. When this happens, the traction wheel 28 is again urged to rotate against the strap to move the strap forward. If the obstruction is still lodged within the strap chute, the driver wheel 48 again disengages from the driven wheel 47. As this process is repeated, owing to the speed of the rotation of the driver wheel 48, the effect is to cause a relatively rapid, on-again, off-again forward feeding force on the strap which causes the end of the strap to "flutter." The fluttering of the end of the strap can serve to knock the obstruction out of the strap chute or can cause the strap to pass under, around, or through the obstruction (or area of excessive friction) and then complete the path in the chute to form the loop.

The "obstruction" discussed immediately above and in the earlier description of the jam-clearing and torque sensing traction assembly need not be restricted to any one particular area in the strap chute. For example, the obstruction can lie in or near the region of strap overlap, just ahead of, in, or beyond any joint forming mechanisms that may be employed to form a joint between the overlapped straps. In fact, an "obstruction" can be purposely designed near the region of the overlapping straps to provide a means for terminating the strap feeding. Such a specifically designed obstruction could also completely replace the previously described sensor means 34, including the movable sensing lever 76, located on the front face of the strapping machine just beyond the region of strap overlap.

Figure 10:
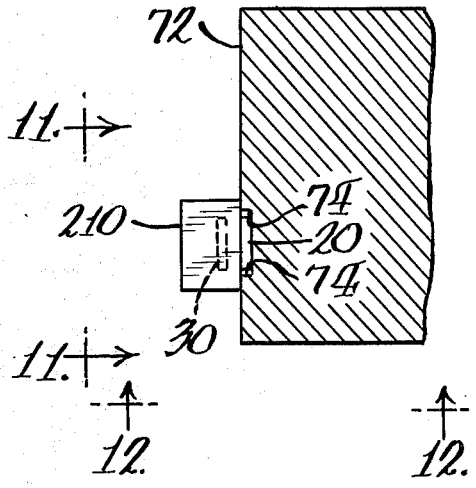
FIG. 10 is a partial sectional view of a modification of the apparatus of the present invention shown in FIG. 5.
Figure 12:
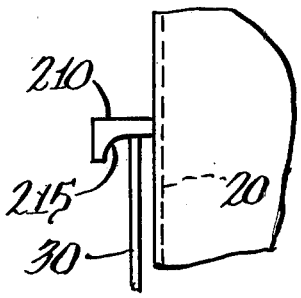
FIG. 12 is a partial side view taken generally along the plane 12—12 of FIG. 10.
Figure 11:
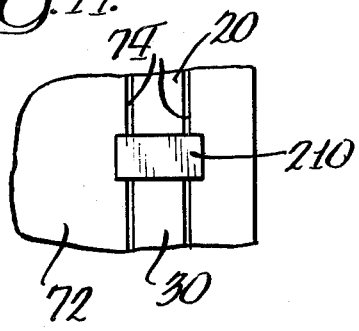
FIG. 11 is a partial front view taken generally along the plane 11—11 of FIG. 10.

In FIGS. 10 through 12, an abutment means 210 is illustrated. The abutment means 210 is positioned on the strapping machine at the same general location as the sensor means 34, illustrated in FIG. 1, just beyond the end of the strap overlap region. Specifically, with reference to FIG. 10, a strap abutment means or member 210 is illustrated as projecting from the front face 72 of the strapping machine strap chute. The strap channel 74 is provided in the face 72 to receive the strap 20 which forms a loop in the strap chute with the strap free end 30 being fed around the strap chute to overlap a portion of the strap 20 at the front face 72 just below the abutment member 210.

In operation, as the strap free end 30 is fed around the strap chute and overlaps a portion of the strap 20, it impinges upon the projecting abutment member 210. To prevent the strap free end 30 from slipping out of contact with the strap abutment member 210, the abutment member preferably has a downwardly depending lip 215. The abutment member 210 acts as an "infinite" resistance in the strap chute which is transmitted back through the strap 20 to the torque sensing clutch through the traction wheel 28 and driven plate 47. As has been previously explained, the driver plate 48 then disengages in response to the increased torque required to rotate the driven plate 47 against the abutment 210 so that the feeding of the strap is terminated. Until the traction wheel motor 46 (FIG. 2) is shut off and until the motor's rotational momentum has descreased to a negligible amount, the strap free end 30 would continue to be intermittently driven against the abutment member 210 and the strap free end 30 would "flutter" as was previously described. Consequently, suitable control means (not illustrated) can be provided to terminate the strap feed motor 46.

Such control means may include a sensing lever, similar to sensing lever 76 previously described and illustrated in FIGS. 1 and 5, which may be located in the strap chute ahead, or upstream, of the joint area. A limit switch associated with the sensing lever can be connected in the motor circuit to stop the motor when the strap free end impinges upon the sensing lever. The motor will continue to rotate under its momentum for a short period of time. The strap will thus be fed past the sensing lever and against the abutment member. Then, upon hitting the abutment member, the strap will transmit the abutment resistance, through the traction wheel, to the clutch assembly which will then disengage to prevent buckling of the strap in the manner that has been previously explained.

With such a strap end abutment member 210, it is not necessary to provide for positive latching of the traction wheel. Thus, the ratchet-pawl latch mechanism (including actuator means 36, pawl 38, and ratchet wheel 40), described earlier and illustrated in FIGS. 2 through 4, need not be incorporated in the strapping machine, thus allowing a simpler machine design. Hence, it is seen that the use of a strap end abutment means 210 in place of the movable sensing lever 76, when combined with the novel torque sensing clutch assembly of the present invention, eliminates the need for complicated and expensive drop-out gate devices (such as illustrated in Crosby et al. U.S. Pat. No. 2,915,003) or the ratchet/-pawl latch mechanism.

Of course, the effectiveness of a strap feed termination system incorporating the strap end abutment member 210 depends upon the combination of the various strap parameters, the rate of strap feed, and the size of the loop being formed. Obviously, with very flexible strap and/or with very large loops, the tendency of the strap to buckle inwardly when the strap free end impinges against the abutment member is greatly increased. However, in situations involving a suitable combination of strap section modulus, strap feed rate, and strap loop size, the permanent abutment structure of the present invention is effective for terminating strap feeding and eliminates the need for more complex mechanisms.

From the foregoing, it will be observed that numerous variations and modifications may be effected without departing from the true spirit and scope of the novel concept of the invention. It is to be understood that no limitation with respect to the specific apparatus illustrated herein is intended or should be inferred. It is, of course, intended to cover by the appended claims all such modifications as fall within the scope of the claims.

What is claimed is:

1. In a strapping machine having a strap chute, a traction wheel and means for rotating said traction wheel to feed said strap into the chute to form and tension a loop about an article, a mechanism for sensing the location of the strap free end and terminating strap feeding, said mechanism comprising:

a ratchet wheel engaged to rotate with said traction wheel;

sensor means for sensing the strap free end at a predetermined location in the chute where said free end overlaps a portion of the loop; and latch means for engaging said ratchet wheel and preventing rotation thereof in one direction in response to said sensor means thereby stopping the rotation of the traction wheel and terminating the feeding of said strap.

2. A mechanism in accordance with claim 1 in which said latch means comprises:

a pawl, actuator means connected to said pawl for moving said pawl in response to said sensor means between an unlatched position disengaged from said ratchet wheel and a latching position for engagement with said ratchet wheel; and pawl bias means for urging one end of said pawl against the teeth of said ratchet wheel to prevent rotation thereof in one direction when said pawl is in said latching position.

3. A mechanism in accordance with claim 2 in which said actuator means comprises an electric solenoid having an arm secured to said pawl.

4. A mechanism in accordance with claim 3 in which said sensor means comprises pivoting lever means extending into said chute and limit switch means mounted for actuation by said lever means, said limit switch means actuating said electric solenoid.

5. A mechanism in accordance with claim 2 in which said sensor means comprises pivoting lever means extending into said chute.

6. A mechanism in accordance with claim 5 in which said latch means includes linkage means connected between said pawl and said pivoting lever means.

7. In a strapping machine for feeding a strap in a chute about an article to form a loop and for tensioning the loop, said machine having a shaft, drive means for rotating said shaft, and a shaft mounted strap traction wheel with a gripping surface for contacting and feeding said strap into the chute to form the loop, a mechanism for sensing the location of the strap free end and terminating strap feeding, said mechanism comprising:

a toothed ratchet wheel on said shaft;

sensor means for sensing the strap free end at a predetermined location where said free end overlaps a portion of the loop; and latch means for engaging said ratchet wheel and preventing rotation thereof in one direction in response to said sensor means thereby stopping the rotation of the traction wheel and terminating the feeding of said strap.

8. In a strapping machine for feeding a strap in a chute about an article to form a loop and for tensioning the loop, a torque sensing assembly, comprising:

a shaft;

drive means for rotating said shaft;

a strap traction wheel mounted on said shaft for rotation with, and relative to, said shaft;

a driven member secured to said traction wheel and having at least one protrusion, said protrusion presenting a first shoulder surface parallel to the axis of rotation of said shaft and presenting a second shoulder surface at an angle thereto;

a driver member mounted on said shaft for sliding therealong and keyed thereto against relative rotation, said driver member having recessed wall means for engaging at least one said protrusion in mating relationship with said first and second shoulder surfaces; and bias means for urging said driver member along said shaft to engage at least one said protrusion in said recessed wall means whereby, when said shaft is rotated in one direction said recessed wall means bears against said second shoulder to rotate said traction wheel to feed the strap until a predetermined amount of resistance to traction wheel rotation is encountered wherein said driver member overcomes said bias means and said recessed wall means slides against said second shoulder and out of engagement therewith to terminate the feeding of the strap.

9. A strapping machine for feeding a strap about an article to form a loop comprising:

a strap chute;

a traction wheel having a gripping surface for contacting said strap;

driver means for engaging said traction wheel;

energizable motor means engaged with said driver means for rotating said driver means and said traction wheel together to feed said strap into said chute to form the loop with the free end of the strap overlapping an adjacent standing segment of said strap;

control means responsive to the location of said strap free end for de-energizing said motor means at a predetermined location of said strap free end;

obstruction means in said chute for blocking the continued forward movement of the free end of said strap owing to the momentum of said motor means; and a torque sensing clutch means for disengaging said drive means from said traction wheel to terminate the continued forward movement of the strap when the momentum of the de-energized motor continues rotating the traction wheel in the direction to continue feeding the strap forward and subjects the traction wheel to a predetermined amount of torque to feed the strap against said obstruction means in the chute.

10. The strapping machine in accordance with claim 9 in which said strap chute includes a region for containing said free end and said adjacent overlapped segment of said strap and in which said obstruction means is a strap end abutment member in said chute at one end of said region.

11. In a strapping machine for feeding a strap in a chute about an article to form a loop and for tensioning the loop, a jam-clearing and torque sensing traction wheel assembly comprising:

a shaft;

a drive means for rotating said shaft;

a strap traction wheel mounted for rotation on, and relative to, said shaft, said traction wheel having a circumferential gripping surface for contacting and feeding said strap;

driver means on said shaft keyed thereto against relative rotation and mounted for sliding therealong between a driving position and a disengaged position;

bias means for urging said driver means from said disengaged position to said driving position;

driven means secured to said traction wheel for being drivably engaged by said driver means in said driven position and for urging said driver means against said bias means to said disengaged position when said traction wheel is subjected to a predetermined amount of torque while rotating in the direction to feed the strap;

a toothed ratchet wheel secured to said traction wheel and rotatably mounted on said shaft;

sensor means for sensing the strap free end at a predetermined location where said free end overlaps a portion of the strap loop; and latch means for engaging said ratchet wheel and preventing rotation of said ratchet wheel and said driven means in one direction in response to said sensor means whereby the strap feeding is terminated and said driver means is forced out of engagement with said driven means to prevent said drive means for locking with the stopped traction wheel.

12. A strapping machine in accordance with claim 11 in which said ratchet wheel is an integral extension of said traction wheel.

13. An assembly in accordance with claim 11 in which said latch means comprises:

a pawl;

actuator means connected to said pawl for moving said pawl in response to said sensor means between an unlatched position disengaged from said ratchet wheel and a latching position for engagement with said ratchet wheel; and pawl bias means for urging one end of said pawl against the teeth of said ratchet wheel to prevent rotation thereof in one direction when said pawl is in said latching position.

14. An assembly in accordance with claim 13 in which said actuator means comprises an electric solenoid having an arm secured to said pawl.

15. An assembly in accordance with claim 14 in which said sensor means comprises pivoting lever means extending into said chute and limit switch means mounted for actuation by said lever means, said limit switch means being connected in an electrical circuit to operate said electric solenoid.

16. An assembly in accordance with claim 13 in which said sensor means comprises pivoting lever means extending into said chute.

17. An assembly in accordance with claim 16 in which said actuator means includes a linkage means connected between said pawl and said pivoting lever means.

18. An assembly in accordance with claim 17 in which said linkage means comprises a cable.

19. A strapping machine for feeding a strap in a chute about an article to form a loop comprising:

a strap chute which includes a joint-forming region adjacent a portion of the machine;

a traction wheel having a gripping surface for contacting said strap;

driver means for engaging said traction wheel;

energizable motor means engaged with said driver means for rotating said driver means and said traction wheel together to feed said strap into said chute to form the loop with the free end of the strap overlapping an adjacent standing segment of said strap in said joint-forming region;

control means responsive to the location of said strap free end for de-energizing said motor means at a predetermined location of said strap free end;

strap free end abutment means located at the downstream end of said joint-forming region in said chute for blocking the continued forward movement of the free end of said strap owing to the momentum of said motor means; and a torque sensing clutch means for disengaging said drive means from said traction wheel to terminate the continued forward movement of the strap when the momentum of the de-energized motor continues rotating the traction wheel in the direction to continue feeding the strap forward and subjects the traction wheel to a predetermined amount of torque to feed the strap against said abutment means in the chute.

20. A strapping machine for feeding a strap in a chute about an article to form a loop comprising:

a strap chute;

a traction wheel having a gripping surface for contacting said strap;

drive means for engaging and rotating said traction wheel to feed said strap into said chute to form the loop; and a torque sensing clutch means for repeatedly disengaging and then re-engaging said drive means from said traction wheel when the traction wheel is rotating in the direction to feed the strap and is subjected to a predetermined amount of torque furnished to feed the strap against an obstruction in said chute thereby causing the strap free end to flutter.

21. A strapping machine for feeding a strap in a chute about an article to form a loop comprising:

a strap chute;

a shaft;

drive means for rotating said shaft;

a strap traction wheel mounted for rotation on, and relative to, said shaft, said traction wheel having a circumferential gripping surface for contacting and feeding said strap to form the loop;

driver means on said shaft keyed thereto against relative rotation and mounted for sliding therealong between a driving position and a disengaged position;

bias means for urging said driver means from said disengaged position to said driving position; and driven means secured to said traction wheel for being drivably engaged by said driver means in said driving position and for urging said driver means against said bias means to said disengaged position when said traction wheel is rotating in the direction to feed the strap and subjected to a predetermined amount of torque furnished to feed the strap against an obstruction in said chute thereby causing the strap free end to flutter.

* * * * *